US006426685B2

(12) United States Patent
Mahlandt et al.

(10) Patent No.: US 6,426,685 B2
(45) Date of Patent: Jul. 30, 2002

(54) RADIATING COAXIAL RADIO-FREQUENCY CABLE

(75) Inventors: Erhard Mahlandt, Laatzen; Mark Davies, Braunschweig, both of (DE)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/816,382

(22) Filed: Mar. 26, 2001

(30) Foreign Application Priority Data

Mar. 28, 2000 (DE) ..... 100 15 379

(51) Int. Cl.[7] ..... H01Q 13/20
(52) U.S. Cl. ..... 333/237; 343/771
(58) Field of Search ..... 333/134, 126, 333/237; 343/770, 771

(56) References Cited

U.S. PATENT DOCUMENTS

| | | | | |
|---|---|---|---|---|
| 3,648,172 A | | 3/1972 | Nakahara et al. | |
| 4,873,531 A | * | 10/1989 | Heddebaut et al. | 343/711 |
| 6,292,072 B1 | * | 9/2001 | Bode et al. | 333/237 |

FOREIGN PATENT DOCUMENTS

| | | |
|---|---|---|
| DE | 2103559 | 8/1971 |
| DE | 0 300 147 B1 | 1/1989 |
| EP | 0 902 499 A1 | 3/1999 |
| JP | 10-145136 | 5/1998 |

* cited by examiner

*Primary Examiner*—Michael Tokar
*Assistant Examiner*—Anh Q. Tran
(74) *Attorney, Agent, or Firm*—Sughrue Mion, PLLC

(57) ABSTRACT

A radiating coaxial radio-frequency cable is specified, that comprises an inner conductor, a dielectric surrounding the latter and a tubular outer conductor disposed above the latter and concentric with the inner conductor. In the outer conductor, mutually separated openings (5) are provided that are disposed in a mutually offset manner in the circumferential direction of the cable and, in the longitudinal direction of the latter, are disposed along surface lines extending mutually in parallel in rows (R1, R2, R3) extending over the entire length of the cable. All the openings (5) extend essentially in the circumferential direction of the cable. For as broadband an operation of the cable as possible, in a first row (R1 ) for operating a frequency range used in mobile radio, openings (5) are disposed in groups (G) in a constantly repeating pattern whose first openings (5), viewed in each case in the axial direction of the cable, are at a mutual spacing (A1) corresponding to half the wavelength of the lowest frequency to be transmitted in the frequency range. In addition, in each group (G), further openings (5) are provided to take account of integral multiples of the lowest frequency to be transmitted in the frequency range. Further openings (5) are situated in at least one second row (R2 ) on a surface line other than that of the openings (5) of the first row (R1) and are disposed over the entire length of the cable at mutual constant spacing that is less than half the wavelength of the highest frequency to be transmitted over the cable.

5 Claims, 2 Drawing Sheets

RADIATING COAXIAL RADIO-FREQUENCY CABLE

BACKGROUND OF THE INVENTION

DESCRIPTION

The invention relates to a radiating coaxial radio-frequency cable, comprising an inner conductor, a dielectric surrounding the latter and a tubular outer conductor disposed above the latter and concentric with the inner conductor, in which cable mutually separated openings are provided in the outer conductor that are disposed in a mutually offset manner in the circumferential direction of the cable and, in the longitudinal direction of the latter, are disposed along surface lines extending mutually in parallel in rows extending over the entire length of the cable (EP 0 300 147 B1).

Because of the electromagnetic energy that travels outwards through the openings, described below as "slots", in the outer conductor, radiating coaxial radio-frequency cables (referred to below as "RRF cables" for short) virtually act as aerials that make possible communication between receivers and transmitters travelling relative to one another. An important field of application of RRF cables is signal transmission in tunnel sections between transmitting and receiving devices and preferably railborne vehicles. The RRF cables are intended to make possible interference-free operation even over long lengths. They are therefore intended to ensure low attenuation of the signals to be transmitted and to have, if possible, no points of reflection. In this connection, the attenuation is the sum of the cable attenuation determined by the RRF cable itself and the coupling attenuation resulting from the radiation of HF energy.

The RRF cable according to EP 0 300 147 B1 mentioned at the outset is intended for broadband operation. In the outer conductor of the latter, round holes are provided on in a first row on a surface line, whereas slots that extend in the axial direction of the cable are disposed in a second row on a surface line offset in the circumferential direction. The holes are intended for a lower frequency range, whereas the slots are intended to serve a higher frequency range. In its application, said RRF cable is limited to two frequency ranges. Measures are not provided for influencing the attenuation of the RRF cable, in particular the coupling attenuation.

SUMMARY OF THE INVENTION

The object of the invention is to develop the RRF cable described at the outset in such a way that it has as uniform coupling attenuation as possible without interfering resonance points in a large frequency range.

According to the invention, this object is achieved in that all the slots extend essentially in the circumferential direction of the cable, in that slots in a first row for operating a frequency range used in mobile radio are disposed in groups in a constantly repeating pattern whose first slots, viewed in each case in the axial direction of the cable, are at a mutual spacing corresponding to half the wavelength of the lowest frequency to be transmitted in the frequency range, in that, in each group, slots are additionally provided to take account of integral multiples of the lowest frequency to be transmitted in the frequency range, and in that further slots are situated in at least one second row on a surface line other than that of the slots of the first row and are disposed over the entire length of the cable at mutual constant spacing that is less than half the wavelength of the highest frequency to be transmitted over the cable.

Said RRF cable can be used without changes in the slot arrangement to transmit signals in a wide frequency range which also covers, in particular, the mobile radio frequencies. This is achieved, on the one hand, by the slots provided with a repeating pattern in the first row with a lowest frequency provided for mobile radio of about 800 MHz. The broadband characteristic is provided, on the other hand, by the equidistant slots, through which lower frequencies or frequency ranges can also be transmitted without interference. In their action, all the slots in the RRF cable complement one another so advantageously that the coupling attenuation can be minimized in the entire frequency spectrum to be transmitted and has a virtually constant magnitude. That is important, in particular, in the mobile-radio frequency range, in which interfering resonance points also do not occur.

The RRF cable can be produced by conventional technology, in which connection a substantial stabilization of the strip from which the outer conductor is formed can be achieved by a distribution of the equidistant slots over two rows.

BRIEF DESCRIPTION OF THE DRAWINGS

Exemplary embodiments of the subject matter of the invention are shown in the drawings.

In the drawings.

DETAILED DESCRIPTION OF THE INVENTION

Figure 1:
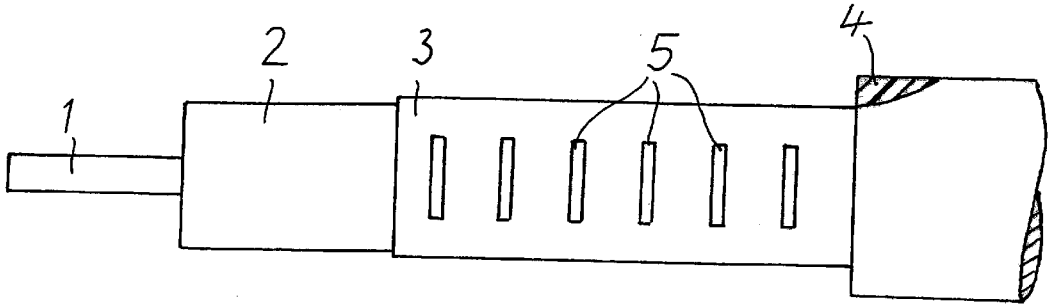
FIG. 1 shows a diagrammatic view of a coaxial RRF cable known per se.

FIG. 1 shows an RRF cable that can be laid, for example, for transmitting signals between stationary and mobile units in a railway tunnel. It has an inner conductor 1, a dielectric 2 and a tubular outer conductor 3 concentrically surrounding the inner conductor 1. The outer conductor 3 is laid, for example, as a longitudinally converging metal strip around the dielectric 3 in such a way the strip edges mutually overlap. They may be mutually joined, for example, by gluing, soldering or welding. The strip edges may, however, also be welded together without overlapping one another. A plastic sheath 4, which may also be flame-resistant, serves as outer mechanical protection.

Inner conductor 1 and outer conductor 3 are preferably composed of copper. The dielectric 2 can be manufactured by conventional technology. It may therefore be a solid dielectric, which may also be foamed, or an air-space dielectric with a coil or discs. Preferably, materials having a low dielectric loss factor, for example polyethylene, are used for the dielectric 2. The sheath 4 may be composed, for example, of polyethylene or polyvinyl chloride.

To achieve the desired "radiation" characteristic, slots 5, which are shown only as a basic embodiment in FIG. 1, are provided in the outer conductor 3 of the RRF cable. In the exemplary embodiment shown, the slots 5 have a rectangular unobstructed cross section. Their length in the circumferential direction of the RRF cable is greater than their axial width. The slots 5 therefore extend essentially in the circumferential direction of the RRF cable. Instead of the rectangular cross section, they could also have an unobstructed cross section curve outwards and quasi-elliptical. The slots 5 may also extend in principle at an angle deviating from 90° to the axis of the RRF cable. That also applies to the slots 5 of the exemplary embodiments of the RRF cable described below.

Figure 2:
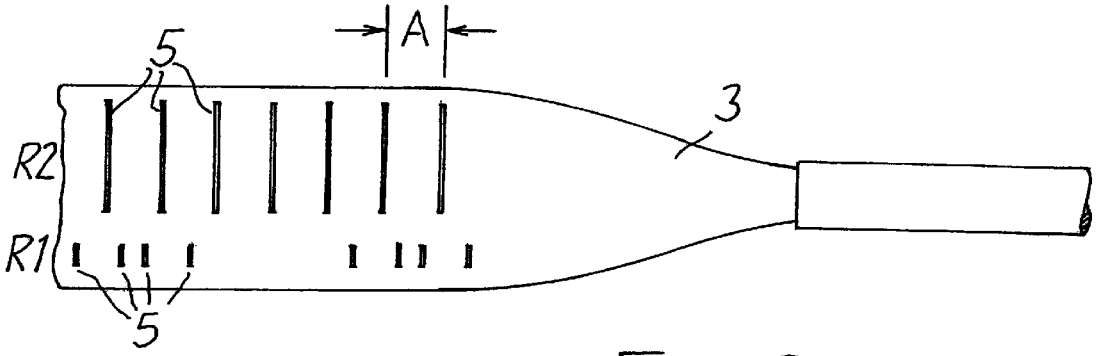
FIGS. 2 and 3 show two different embodiments of an RRF cable according to the invention having an outer conductor that is flattened at the end.

In the exemplary embodiment of the RRF cable according to FIG. 2, the slots 5 are provided in two rows R1 and R2 that lie on different surfaces lines of the RRF cable. In the first row R1, the slots 5 are disposed in a constantly repeating pattern with varying spacings. This arrangement of the slots 5 is explained more precisely below with reference to FIG. 4. The slots 5 of the second row R2 have a constant mutual spacing A over the entire length of the RRF cable. The spacing A is dependent on the highest frequency to be transmitted with the RRF cable. To avoid interference, the spacing A is less than half the wavelength of said highest frequency.

The chosen unobstructed width of the equidistant slots 5 of the second row R2 should be relatively large, likewise to avoid interference. Since their axial width cannot be made arbitrarily large, they have a corresponding large size in the circumferential direction. In some cases, the mechanical stability of an outer conductor 3 of the RRF cable provided with such large or long slots 5 may be impaired. In a preferred embodiment of the RRF cable, the equidistant slots 5 are therefore distributed in two mutually separate rows R2 and R3 situated on different surface lines. A corresponding exemplary embodiment of the RRF cable emerges from FIGS. 3 and 4.

Figure 3:
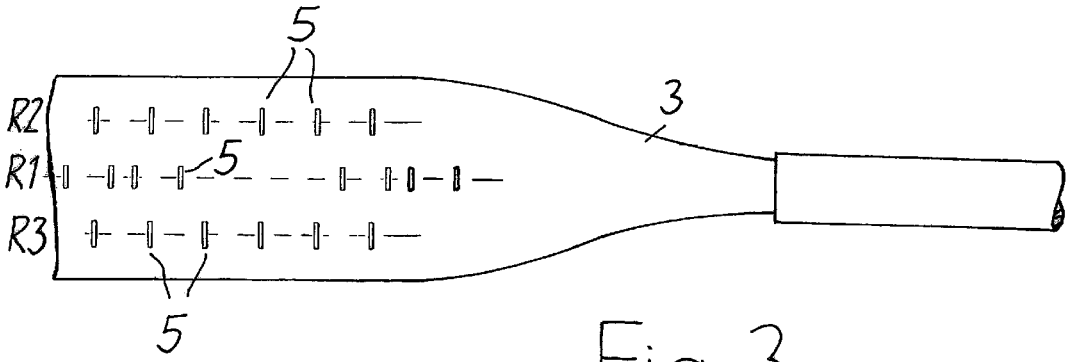

In the RRF cable according to FIGS. 3 and the slots 5 are disposed in three rows R1, R3 and R3 that extend on three surface lines that are mutually offset in the circumferential direction of the RRF cable and are parallel to the axis. In a preferred embodiment, each of the rows R1, R2 and R3 are mutually offset by 120°. In all three row R1, R2 and R3, the slots 5 are present over the entire length of the RRF cable. In rows R2 and R3, the slots 5 are, over the entire length of the cable, at a constant mutual spacing A that has already been explained for FIG. 2. The slots 5 in rows R2 and R3 preferably have the some dimensions.

In the first row R1, the slots 5 are disposed in a constantly repeating pattern with a variable mutual spacing. In accordance with the exemplary embodiment shown, said pattern comprises four slots S1, S2, S3 and S4 belonging to one group G. The slots 5 of the first row R1 serve to operate the frequency range intended for mobile radio, having a lowest frequency of, for example, 800 MHz. Each first slots S1 of the consecutive groups G are at a spacing A1 from one another that corresponds to half the wavelength (□/2) of the lowest frequency in the frequency range.

The other slots S2, S3 and S4 of the consecutive groups G take account of integral multiples of the lowest frequency covered by the slots S1 in the frequency range. Each slot S2 is at spacing A2 from the slot S1, which spacing corresponds to one eighth (□/8) of the wavelength of the lowest frequency in the frequency range. This takes account of a frequency that is twice the lowest frequency. The slot S3 is at a spacing A3 from the slot S1 that is equal to one twelfth (□/12) of the lowest frequency in the frequency range. This covers a frequency that is equal to three times the lowest frequency. In terms of action, the slot S4 that is at the same spacing A3 from the slot S2 as the slot S3 from the slot S1 also belongs to the slot S3.

Figure 5:
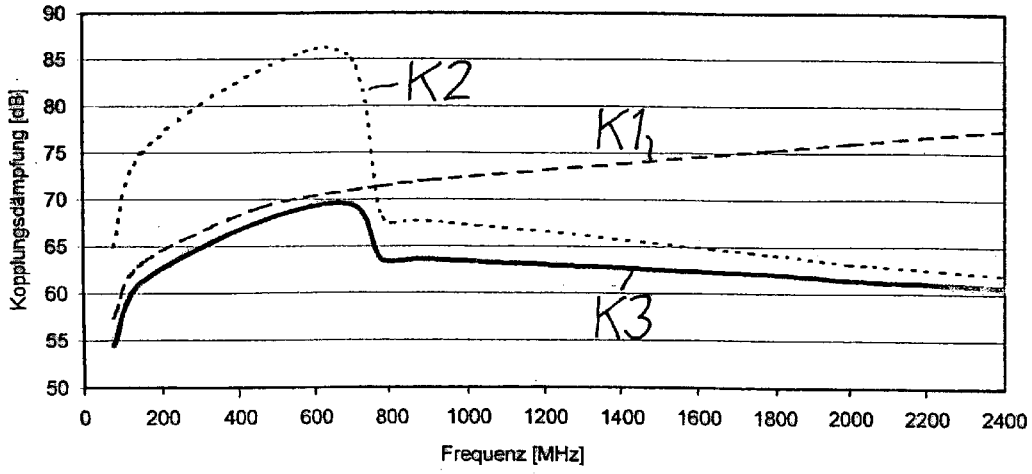
FIG. 5 is a diagram of the variation in the coupling attenuation of the RRF cable.

Advantages and mode of operation of the RRF cable according to the invention are summarized below with reference to the attenuation curves according to FIG. 5:

FIG. 5 shows the coupling attenuation over a frequency range extending from 0 to 2400 MHz. This also covers the frequency range used for mobile radio, which in current technology lies between about 800 MHz and 2400 MHz.

Figure 4:
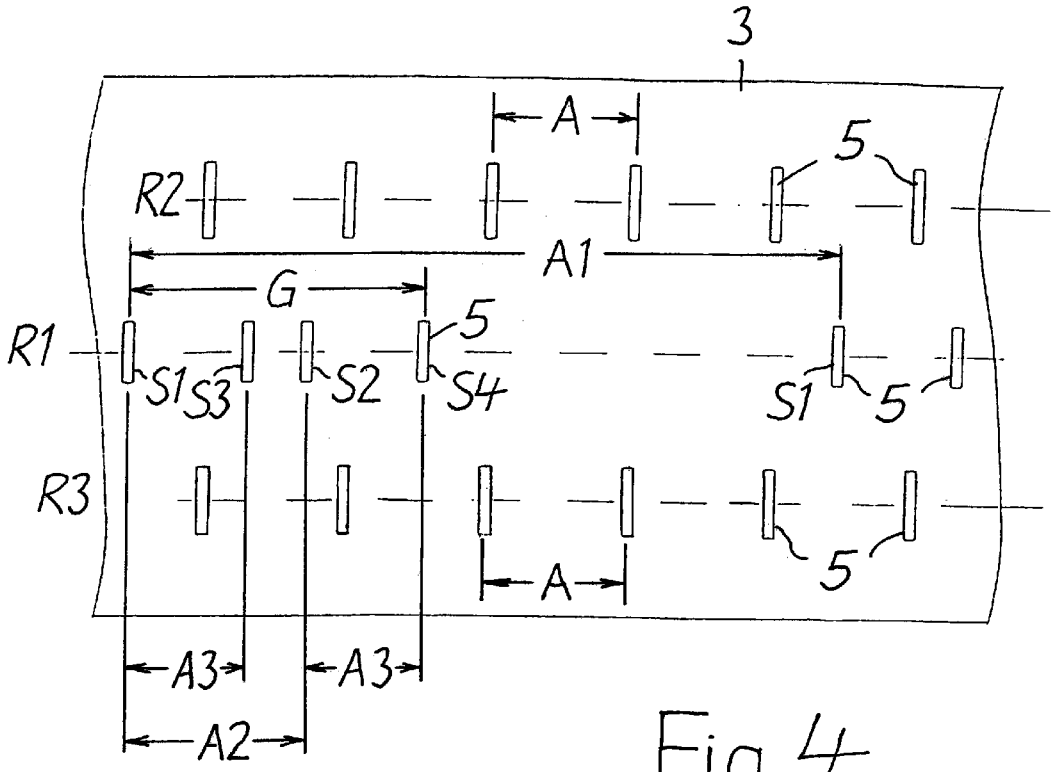
FIG. 4 shows a portion of the outer conductor with a more precise and enlarged view of an arrangement of the slots for the RRF cable according to FIG. 3.

The curve K1 reproduces the variation in the coupling attenuation for an RRF cable that has only slots 5 in accordance with row R2 (FIG. 2) or in accordance with the rows R2 and R3 (FIGS. 3 and 4). The coupling attenuation increases with increasing frequency, which is undesirable. The curve K2 shows the variation in the coupling attenuation for an RRF cable that has only slots 5 in accordance with row R1. Here the coupling attenuation is very high in a region below about 800 MHz, with the result that such an RRF cable could not be used expediently in this frequency range.

The variation in the coupling attenuation for an RRF cable according to the invention is reproduced by curve K3. Except for a discontinuity at a frequency of about 700 MHz, the values of the coupling attention are in this case very low and they are nearly constant over the entire frequency range. That applies, in particular, to the frequencies lying above 800 MHz, that is to say to the mobile radio frequency range. In this range, the coupling attenuation even decreases slightly with increasing frequency. In addition, no interfering resonance points are present in this region.

What is claimed is:

1. Radiating coaxial radio-frequency cable, comprising an inner conductor, a dielectric surrounding the latter and a tubular outer conductor disposed above the latter and concentric with the inner conductor, in which cable mutually separated openings are provided in the outer conductor that are disposed in a mutually offset manner in the circumferential direction of the cable and, in the longitudinal direction of the latter, are disposed along surface lines extending mutually in parallel in rows extending over the entire length of the cable, characterized in that all the openings (5) extend essentially in the circumferential direction of the cable, in that openings (5) in a first row (R1) for operating a frequency range used in mobile radio are disposed in groups (G) in a constantly repeating pattern whose first opening (5) viewed in each case in the axial direction of the cable are at a mutual spacing (A1) corresponding to half the wavelength of the lowest frequency to be transmitted in the frequency range, in that, in each group (G), openings (5) are additionally provided to take account of integral multiples of the lowest frequency to be transmitted in the frequency range, and in that further openings (5) are situated in a second row (R2) on a surface line other than that of the openings (5) of the first row (R1) and are disposed over the entire length of the cable at mutual constant spacing that is less than half the wavelength of the highest frequency to be transmitted over the cable.

2. Cable according to claim 1, characterized in that the openings (5) are disposed at a constant mutual spacing in two separate rows (R2, R3) on different surface lines.

3. Cable according to claim 1, characterized in that, in each group (G) of the first row (R1), a second opening (5)

is provided that is at a distance (A2) from the respective first opening (5) that is one eighth of the wavelength of the lowest frequency to be transmitted in the frequency range.

4. Cable according to claim 1, characterized in that, in each group (G) of the first row (R1), two further openings (5) are provided, of which one is at a spacing (A3) from the first opening (5) and the other is at a spacing (A3) from the second opening (5), which spacing corresponds to one twelfth of the wavelength of the lowest frequency to be transmitted in the frequency range.

5. Cable according to claim 1, characterized in that the openings (5) have a rectangular unobstructed cross section.

* * * * *